US008841828B2

(12) United States Patent
Igarashi et al.

(10) Patent No.: US 8,841,828 B2
(45) Date of Patent: Sep. 23, 2014

(54) SPARK PLUG

(75) Inventors: Tomoyuki Igarashi, Aichi (JP); Ryuichi Ohno, Aichi (JP); Tatsunori Yamada, Aichi (JP); Katsutoshi Nakayama, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/235,824

(22) PCT Filed: Jun. 8, 2012

(86) PCT No.: PCT/JP2012/003755

§ 371 (c)(1),
(2), (4) Date: Jan. 29, 2014

(87) PCT Pub. No.: WO2013/018264

PCT Pub. Date: Feb. 7, 2013

(65) Prior Publication Data

US 2014/0175967 A1 Jun. 26, 2014

(30) Foreign Application Priority Data

Aug. 4, 2011 (JP) ..... 2011-170905

(51) Int. Cl.
*H01T 13/20* (2006.01)
*H01T 13/16* (2006.01)

(52) U.S. Cl.
CPC ..... *H01T 13/16* (2013.01)
USPC ..... 313/141; 445/7

(58) Field of Classification Search
USPC ..... 313/118–141
See application file for complete search history.

(56) References Cited

U.S. PATENT DOCUMENTS

| | | | | |
|---|---|---|---|---|
| 5,273,474 | A | 12/1993 | Oshima et al. | 445/7 |
| 5,461,276 | A * | 10/1995 | Matsutani et al. | 313/141 |
| 6,528,929 | B1 | 3/2003 | Matsutani et al. | 313/141 |
| 2011/0133625 | A1 * | 6/2011 | Sakayanagi et al. | 313/141 |

FOREIGN PATENT DOCUMENTS

| | | | |
|---|---|---|---|
| JP | 63-55880 | 3/1988 | H01T 13/20 |
| JP | 5013145 | 1/1993 | H01T 13/20 |
| JP | 5-159860 | 6/1993 | H01T 21/02 |
| JP | 10-106716 | 4/1998 | H01T 13/20 |
| JP | 2000-208235 | 7/2000 | H01T 13/20 |
| JP | 2002-289319 | 10/2002 | H01T 13/20 |
| JP | 2005-150011 | 6/2005 | H01T 13/20 |

OTHER PUBLICATIONS

Form PCT/ISA/210—Int'l Search Report (from corresponding Int'l Patent App. No. PCT/JP2012/003755—English version only); 2 pages.

* cited by examiner

*Primary Examiner* — Anne Hines
(74) *Attorney, Agent, or Firm* — Kusner & Jaffe

(57) ABSTRACT

A spark plug has a center electrode having an electrode base member and a core material which is disposed in the electrode base member and which predominantly contains copper, and a noble metal tip disposed at a forward end of the center electrode, and a fusion portion formed between the noble metal tip, and the electrode base member and the core material. The fusion portion is in contact with the core material in a cross section which is parallel to the center axis of the center electrode and which passes through the center axis and the fusion portion. The fusion portion contains a component of the noble metal tip, a component of the electrode base member, and a copper component forming the core material.

7 Claims, 12 Drawing Sheets

FIG. 5A
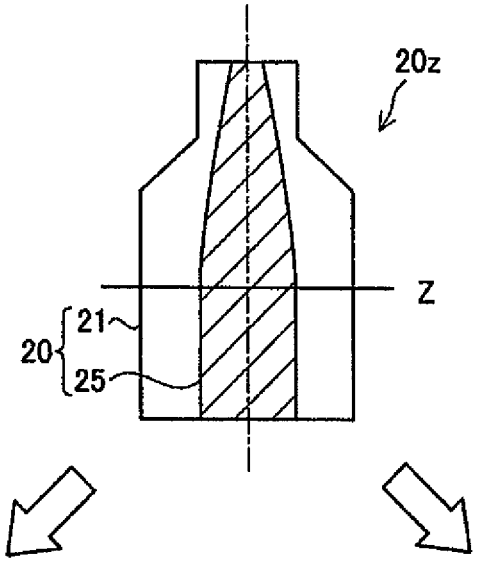
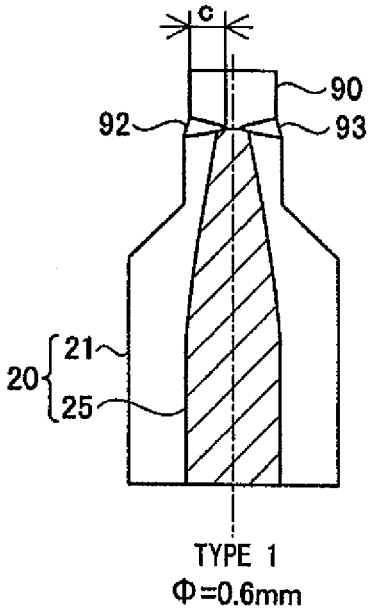
FIG. 5B
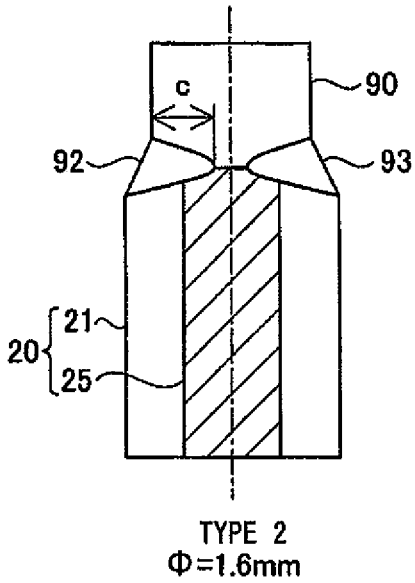
FIG. 5C

SPARK PLUG

FIELD OF THE INVENTION

The present invention relates to a spark plug.

BACKGROUND OF THE INVENTION

A known technique relating to a spark plug having a noble metal tip at the forward end of the center electrode is disclosed in Japanese Patent Application Laid-Open (kokai) No. 5-159860. In this technique, the forward end of the center electrode is provided with a dented portion for accommodating a noble metal tip, and a noble metal tip is fit into the dented portion. The noble metal tip is fixed through welding the periphery thereof.

According to the known technique, however, the noble metal tip must have a sufficient length, making use of a noble metal tip having a short length difficult. Thus, difficulty is encountered in enhancing the heat transfer performance of the noble metal tip. Also, since the fusion portion formed through welding has low thermal conductivity, heat transfer of the noble metal tip is problematically impeded.

Also considered relevant prior art is Japanese Patent Application Laid-Open (kokai) No. 5-013145.

The present invention has been conceived to solve, at least partially, the above problems. An advantage of the invention is a technique for enhancing the heat transfer performance of a fusion portion and a noble metal tip.

SUMMARY OF THE INVENTION

For solving, at least partially, the above problems, the present invention may be embodied in the following modes or application examples.

Application Example 1

In accordance with a first embodiment of the present invention, there is provided a spark plug comprising:

a center electrode having an electrode base member and a core material which is disposed in the electrode base member and which predominantly contains copper; and a noble metal tip disposed at a forward end of the center electrode;

the spark plug has a fusion portion formed between the noble metal tip, and the electrode base member and the core material; and in a cross section which is parallel to the center axis of the center electrode and which passes through the center axis and the fusion portion, the fusion portion is in contact with the core material and contains a component of the noble metal tip, a component of the electrode base member, and a copper component forming the core layer.

Application Example 2

In accordance with second embodiment of the present invention, there is provided a spark plug as described in Application example 1, wherein, in the cross section, the fusion portion has a copper component content of 10 wt. % or more at the centroid G of a region R which is defined between a straight line L1 and the center axis, wherein the straight line L1 passes through a point P1 and is parallel to the center axis, and the point P1 is on the interface between the fusion portion and the core material and is closest to the outer peripheral surface of the center electrode.

Application Example 3

In accordance with a third embodiment of the present invention, there is provided a spark plug as described in Application examples 1 or 2, wherein, in the cross section, the spark plug satisfies a relationship: $b \geq 0.2$ mm, wherein b is a distance between a straight line L1 and a straight line L2; the straight line L1 passes through a point P1 and is parallel to the center axis; the point P1 is on the interface between the fusion portion and the core material and is closest to the outer peripheral surface of the center electrode; the straight line L2 passes through a point P2 and is parallel to the center axis; and the point P2 is on the interface between the core material and a second fusion portion formed on the side of the center axis opposite the fusion portion and is closest to the outer peripheral surface of the center electrode.

Application Example 4

In accordance with a fourth embodiment of the present invention, there is provided a spark plug as described in any one of Application examples 1 to 3, wherein, in the cross section, the spark plug satisfies a relationship: $a \leq 0.3$ mm, wherein a is a distance between a point P1 and a point P3; the point P1 is on the interface between the fusion portion and the core material and is closest to the outer peripheral surface of the center electrode; the straight line L1 passes through the point P1 and is parallel to the center axis; and the point P3 is a point of intersection of the straight line L1 and an outline of the fusion portion on the noble metal tip side.

Application Example 5

In accordance with a fifth embodiment of the present invention, there is provided a spark plug as described in any one of Application examples 1 to 4, wherein, the noble metal tip is in contact with the core material.

The present invention may be embodied in various forms. For example, the present invention may be embodied in a method for manufacturing a spark plug, an apparatus for manufacturing a spark plug, etc.

Since the spark plug of Application example 1 contains a copper component in the fusion portion, thermal conductivity of the fusion portion can be enhanced. Thus, the heat transfer performance of the fusion portion as well as that of the noble metal tip can be enhanced.

According to the spark plug of Application example 2, the core material of the center electrode is formed mainly of copper, resulting in high thermal conductivity. The region R of the fusion portion is present between the core material of the center electrode and the noble metal tip, and significantly determines the heat transfer performance of the noble metal tip. In Application example 2, the copper component content at the centroid G of the region R is 10 wt. % or more, thereby increasing thermal conductivity of the region R of the fusion portion. Thus, the heat transfer performance of the fusion portion as well as that of the noble metal tip can be enhanced.

The distance b is the width of a portion of the core material which portion is in contact with the fusion portion and the noble metal tip. According to the spark plug of Application example 3, the longer the distance b, the wider the contact area between the core material and the fusion portion and between the core material and the noble metal tip. Thus, the heat transfer performance of the fusion portion and the noble metal tip can be enhanced. In Application example 3, since the distance b is 0.2 mm or more, the heat transfer performance of the fusion portion as well as that of the noble metal tip can be enhanced.

The length a is the largest thickness of the fusion portion formed between the noble metal tip and the core material of the center electrode. According to the spark plug of Application example 4, the closer the core material of the center electrode to the noble metal tip; i.e., the shorter the length a, the more effective the transfer of heat of the noble metal tip to the core material of the center electrode. Thus, the heat transfer performance of the noble metal tip can be enhanced. In Application example 4, since the length a is 0.3 mm or less, the heat transfer performance of the noble metal tip can be enhanced. According to the spark plug of Application example 5, since the noble metal tip is in contact with the core material, heat of the noble metal tip is transferred directly to the core material of the center electrode, whereby the heat transfer performance of the noble metal tip can be enhanced.

BRIEF DESCRIPTION OF THE DRAWINGS

FIGS. 5A, 5B, 5C are explanatory views of types of samples of the noble metal tip 90 having different diameters.

DETAILED DESCRIPTION OF PREFERRED EMBODIMENTS

Embodiments of the present invention will next be described along with experimental examples in the following order: A; embodiment, B; Experimental Examples including B1; an experiment for elucidating the relationship between the presence of copper in the fusion portion 92 and heat transfer performance, B2; an experiment for elucidating the relationship between copper content of the fusion portion 92 and heat transfer performance, B3; an experiment for elucidating the relationship between core material width b and heat transfer performance, and B4; an experiment for elucidating the relationship between fusion width a and heat transfer performance, C; other embodiments, and D; modifications.

A. Embodiment

Figure 1:
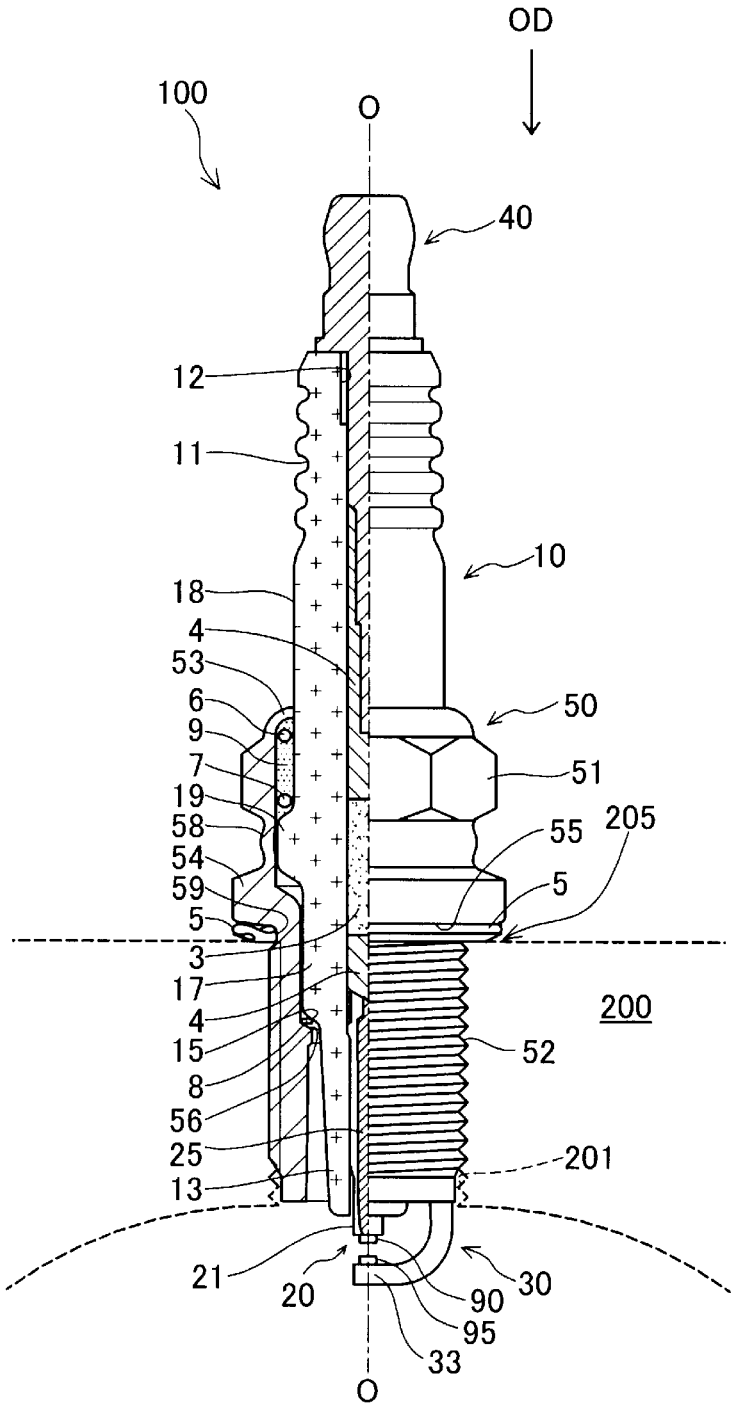
FIG. 1 is a partial sectional view of a spark plug 100 illustrating one embodiment of the present invention.

FIG. 1 is a partial sectional view of a spark plug 100 as an embodiment of the present invention. In the following description, an axial direction OD of the spark plug 100 in FIG. 1 is referred to as the vertical direction in the drawings; the lower side is referred to as the forward side of the spark plug; and the upper side as the rear side. In FIG. 1, the right half with respect to an axis O is an external view of the spark plug 100, and the left half is a sectional view of the spark plug 100 cut by a plane which passes the axis O (hereinafter may also be referred to as a center axis O).

The spark plug 100 has a ceramic insulator 10, a metallic shell 50, a center electrode 20, a ground electrode 30, and a metal terminal 40. The center electrode 20 is sustained by an axial bore 12 disposed in the ceramic insulator 10, while it extends in the axial direction OD. The ceramic insulator 10 serves as an insulator and is surrounded by and inserted into the metallic shell 50. The metal terminal 40, which serves as a terminal for receiving electric power, is disposed at the rear end of the ceramic insulator 10.

The ceramic insulator 10 is an insulator formed from, for example, alumina through firing. The ceramic insulator 10 is a tubular insulator and has an axial bore 12 extending therethrough in the axial direction OD; i.e., formed along the center axis. The ceramic insulator 10 has a collar portion 19 formed substantially at the center in the axial direction OD and having the greatest outside diameter. A rear trunk portion 18 is formed rearward of the collar portion 19. The rear trunk portion 18 has a corrugated portion 11 for enhancing electrically insulating properties through elongation of surface length. The ceramic insulator 10 also has a forward trunk portion 17 formed forward of the collar portion 19 and being smaller in outside diameter than the rear trunk portion 18. The ceramic insulator 10 further has a leg portion 13 formed forward of the forward trunk portion 17 and being smaller in outside diameter than the forward trunk portion 17. The leg portion 13 reduces in outside diameter toward the forward end thereof. When the spark plug 100 is mounted to an engine head 200 of an internal combustion engine, the leg portion 13 is exposed to the interior of a combustion chamber of the internal combustion engine. A stepped portion 15 is formed between the leg portion 13 and the forward trunk portion 17.

The center electrode 20 is exposed from the forward end of the ceramic insulator 10 and extends rearward along the center axis O. The center electrode 20 is a rod-like electrode and has a structure in which a core material 25 is embedded in an electrode base member 21. The electrode base member 21 is formed of nickel or a nickel-base alloy, such as INCONEL 600 or INCONEL 601 ("INCONEL" is a trade name). The core material 25 is formed of copper or a copper-base alloy, having a thermal conductivity higher than that of the electrode base member 21. As used herein, the term "copper-base alloy" refers to an alloy having a copper content of 95% or higher. Hereinafter, the core material 25 may be referred to as an "inner layer 25." Usually, the center electrode 20 is manufactured as follows: the core material 25 is embedded in the electrode base member 21 formed into a closed-bottomed tubular shape; then, the resultant assembly is subjected to extrusion from the bottom side for drawing. In the axial bore 12, the center electrode 20 is electrically connected to the metal terminal 40 disposed at the rear end of the ceramic insulator 10, via a seal member 4 and a ceramic resistor 3.

The metallic shell 50 is a tubular member formed of low-carbon steel and holds the ceramic insulator 10 therein. The metallic shell 50 surrounds a portion of the ceramic insulator 10 ranging from the leg portion 13 to a portion of the rear trunk portion 18.

The metallic shell 50 includes a tool engagement portion 51 and a mounting threaded portion 52. The tool engagement portion 51 is where a spark plug wrench (not shown) is engaged. The mounting threaded portion 52 of the metallic shell 50 is where a thread is formed, and is threadingly engaged with a mounting threaded hole 201 of the engine head 200 provided at an upper portion of an internal combustion engine. In this manner, by means of the mounting threaded portion 52 of the metallic shell 50 being threadingly engaged with the mounting threaded hole 201 of the engine head 200 and being tightened, the spark plug 100 is fixed to the engine head 200 of the internal combustion engine.

The metallic shell 50 has a flange-like collar portion 54 formed between the tool engagement portion 51 and the mounting threaded portion 52 and protruding radially outward. An annular gasket 5 formed by folding a sheet material is fitted to a screw neck 59 located between the mounting threaded portion 52 and the collar portion 54. When the spark plug 100 is mounted to the engine head 200, the gasket 5 is crushed and deformed between a seat surface 55 of the collar portion 54 and a peripheral-portion-around-opening 205 of the mounting threaded hole 201. By virtue of deformation of the gasket 5, a seal is established between the spark plug 100 and the engine head 200, thereby restraining leakage of combustion gas through the mounting threaded hole 201.

The metallic shell 50 has a thin-walled crimped portion 53 formed rearward of the tool engagement portion 51. The metallic shell 50 also has a buckled portion 58 formed between the collar portion 54 and the tool engagement portion 51 and thin-walled similar to the crimped portion 53. Annular ring members 6 and 7 are inserted between the outer circumferential surface of the rear trunk portion 18 of the ceramic insulator 10 and an inner circumferential surface of the metallic shell 50 ranging from the tool engagement portion 51 to the crimped portion 53. A powder of talc 9 is charged into a space between the two ring members 6 and 7. By means of a crimped portion 53 being bent radially inward for crimping, the ceramic insulator 10 is fixed to the metallic shell 50. An annular sheet packing 8 intervenes between the stepped portion 15 of the ceramic insulator 10 and a stepped portion 56 formed on the inner circumferential surface of the metallic shell 50 and maintains gas-tightness between the metallic shell 50 and the ceramic insulator 10, thereby preventing leakage of combustion gas. A buckled portion 58 is configured to be deformed radially outward through application of compressive force in the step of crimping, and thereby ensures the length of compression of the talc 9 so as to enhance gas-tightness within the metallic shell 50.

A ground electrode 30 is joined to the forward end of the metallic shell 50 and is bent toward the center axis O from the forward end of the metallic shell 50. The ground electrode 30 may be formed of a nickel alloy having high corrosion resistance, such as INCONEL 600 ("INCONEL" is a trade name). Welding may be employed for joining the ground electrode 30 to the metallic shell 50. A distal end 33 of the ground electrode 30 faces the center electrode 20.

An unillustrated high-voltage cable is connected to the metal terminal 40 of the spark plug 100 through a plug cap (not illustrated). Spark discharge is generated between the ground electrode 30 and the center electrode 20 through application of high voltage between the metal terminal 40 and the engine head 200.

To the center electrode 20 and the ground electrode 30, columnar electrode tips 90, 95 each containing a high-melting-point noble metal as a main component are attached, respectively. Specifically, the electrode tip 90 formed of, for example, iridium (Ir) or an Ir-base alloy containing one or more additive elements selected from among platinum (Pt), rhodium (Rh), ruthenium (Ru), palladium (Pd), and rhenium (Re) is attached to the forward end surface of the center electrode 20. Also, the electrode tip 95 formed of platinum or a platinum-base material is attached to the surface of the distal end 33 of the ground electrode 30 which faces the center electrode 20. Hereinafter, the electrode tip may be also referred to as a "noble metal tip."

Figure 2:
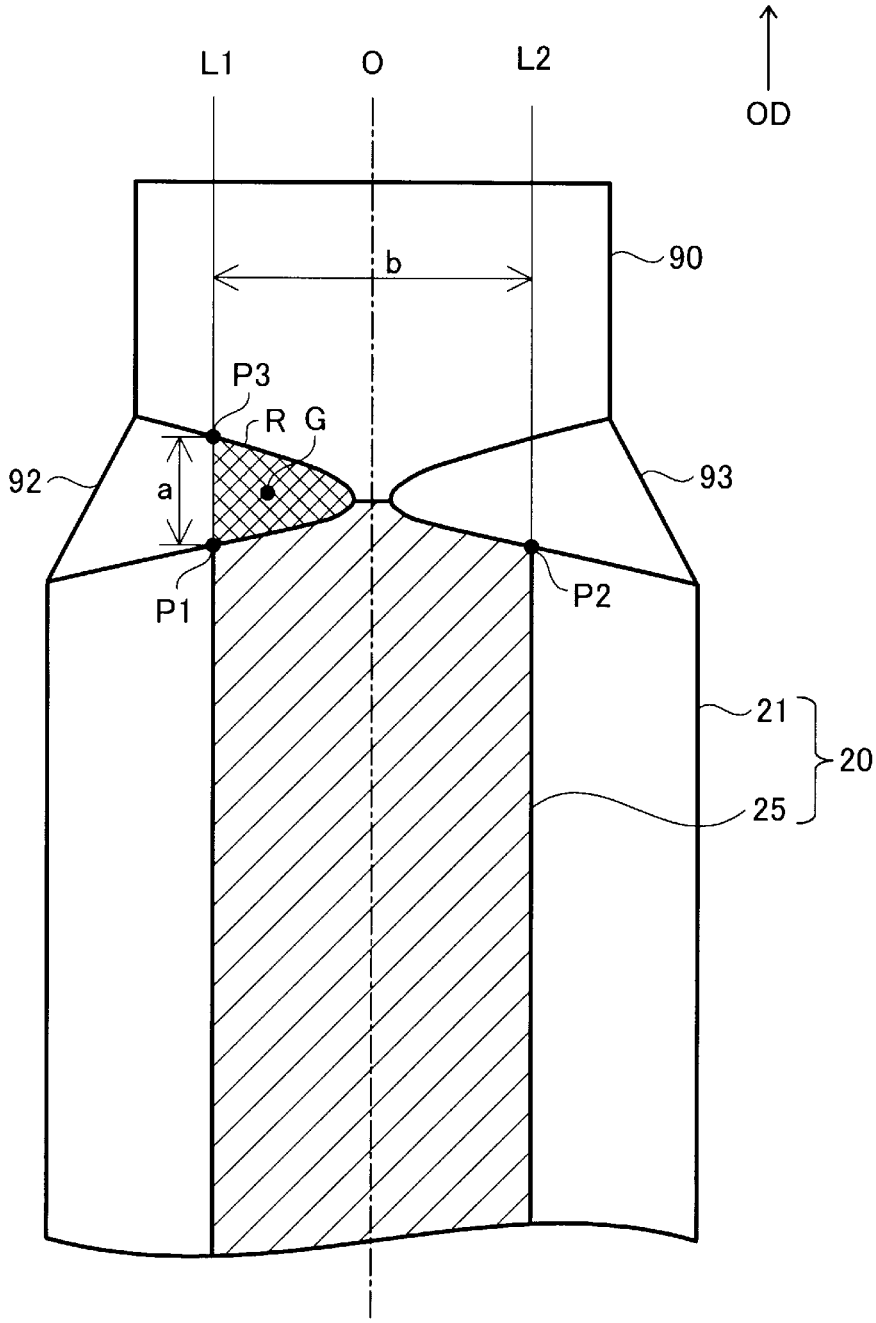
FIG. 2is an enlarged sectional view of a center electrode 20 and a noble metal tip 90.

FIG. 2 is an enlarged sectional view of the center electrode 20 and the noble metal tip 90. In FIG. 2, the axial direction OD represented by an arrow corresponds to the forward direction. The cross section shown in FIG. 2 is parallel to the center axis O of the center electrode and passes the fusion portion 92.

In this embodiment, the fusion portion 92 is formed between the noble metal tip 90, and the electrode base member and the inner layer. The fusion portion 92 is in contact with the inner layer, i.e., core material, 25, and contains a component of the noble metal tip 90, a component of the electrode base member 21, and a copper component forming the inner layer 25. When the fusion portion 92 contains a copper component, thermal conductivity of the fusion portion 92 increases, to thereby enhance heat transfer performance. In addition, when the heat transfer performance of the fusion portion 92 is enhanced, the heat transfer performance of the noble metal tip 90 can be enhanced.

The fusion portion 92 may be formed through irradiation of the interface between the noble metal tip 90 and the center electrode 20 with a fiber laser beam or an electron beam from the side orthogonal to the center axis. Such a fiber laser beam or an electron beam, which has a considerably high unit-area energy intensity, can melt the high-melting inner layer 25. In this embodiment, the fusion portion 92 is formed so as to cover the entire side surface of the noble metal tip 90.

In the cross section shown in FIG. 2, the point P1 is on the interface between the fusion portion 92 and the inner layer 25 and is closest to the outer peripheral surface of the center electrode 20. The straight line L1 passes through the point P1 and is parallel to the center axis. In the fusion portion 92, a region R is defined between a straight line L1 and the center axis O (a cross-line-hatched area in FIG. 2). In this embodiment, the copper component content at the centroid G of the region R is 10 wt. % or more, thereby increasing the heat transfer performance of the fusion portion 92 as well as that of the noble metal tip 90. The reason for this is as follows.

The inner layer 25 of the center electrode 20, which is formed mainly of copper, has high thermal conductivity. The region R of the fusion portion 92, which is present between the inner layer 25 of the center electrode 20 and the noble metal tip 90, is the most important area that determines the heat transfer performance of the noble metal tip 90. In this embodiment, since the copper component content at the centroid G of the region R is 10 wt. % or more, the thermal conductivity of the region R of the fusion portion 92 can be elevated. Therefore, the heat transfer performance of the fusion portion 92 as well as that of the noble metal tip 90 can be enhanced.

The fusion portion 92 can be formed through modifying the copper component content of the inner layer 25, or adjusting the output, irradiation time, and irradiation direction of a fiber laser beam or an electron beam. The criteria for determining the copper component content to fall within the aforementioned range will be described hereinbelow. In the cross section shown in FIG. 2, the centroid G of the region R is also referred to as a "barycenter G."

In this embodiment, the second fusion portion 93 is formed on the side of the center axis O opposite the fusion portion 92. As described above, since the fusion portion 92 is formed so as to cover the entire side surface of the noble metal tip 90, the fusion portion 92 and the second fusion portion 93 are integrated to cover the entire side surface of the noble metal tip 90.

In the cross section, the point P2 is on the interface between the inner layer 25 and the second fusion portion 93 and is closest to the outer peripheral surface of the center electrode 20. The straight line L2 passes through the point P2 and is parallel to the center axis O. The distance between the straight line L1 and a straight line L2 is represented by b. The spark plug 100 of this embodiment satisfies the following relationship: $b \geq 0.2$ mm . . . (1). Under this condition, the fusion portions 92, 93 and the noble metal tip 90 can have enhanced heat transfer performance. The reason for this is as follows.

The distance b is a width of a portion of the inner layer 25 which is in contact with the fusion portions 92, 93 and the noble metal tip 90. The longer the distance b, the wider the contact area between the inner layer and the fusion portions 92, 93 and between the inner layer and the noble metal tip 90, whereby the heat transfer performance of the fusion portions 92, 93 and the noble metal tip 90 can be enhanced. The criteria for determining the distance b to fall within the aforementioned range will be described hereinbelow. Hereinafter, the distance b is also referred to as a "inner layer width b."

In the cross section shown in FIG. 2, the point P3 is an intersection between the straight line L1 and the outline of the fusion portion 92 on the noble metal tip 90 side. The distance between the point P1 and the point P3 is represented by a. The spark plug 100 of this embodiment satisfies the following relationship: $a \leq 0.3$ mm . . . (2). Under this condition, the heat transfer performance of the noble metal tip 90 can be enhanced. The reason for this is as follows.

The length a is the largest thickness of the fusion portion 92 formed between the noble metal tip 90 and the inner layer 25 of the center electrode 20. The closer the inner layer 25 of the center electrode 20 to the noble metal tip 90; i.e., the shorter the length a, the more effective the transfer of heat of the noble metal tip to the inner layer of the center electrode. Thus, the heat transfer performance of the noble metal tip 90 can be enhanced. The criteria for determining the length a to fall within the aforementioned range will be described hereinbelow. Hereinafter, the length a is also referred to as a "fusion length a."

In this embodiment, since the noble metal tip 90 is in contact with the inner layer 25, heat of the noble metal tip 90 is transferred directly to the inner layer 25, whereby the heat transfer performance of the noble metal tip 90 can be further enhanced.

B. Experimental Examples

B1. An Experimental Example for Elucidating the Relationship Between the Presence of Copper in the Fusion Portion 92 and Heat Transfer Performance In Experimental Example B1, in order to elucidate the relationship between the presence of copper in the fusion portion 92 and the heat transfer performance of the noble metal tip 90, two samples containing no copper component in the fusion portion 92 (Comparative Examples 1, 2) and a sample containing a copper component in the fusion portion 92 were provided. The noble metal tip 90 of each sample was heated to 900° C. by means of a burner, and then heating was stopped. Thirty seconds after termination of heating, the temperature of the discharge face of the noble metal tip 90 was measured by means of a radiation thermometer. The samples were assessed with comparison in terms of heat transfer performance.

Figures 3A, 3B, 3C:
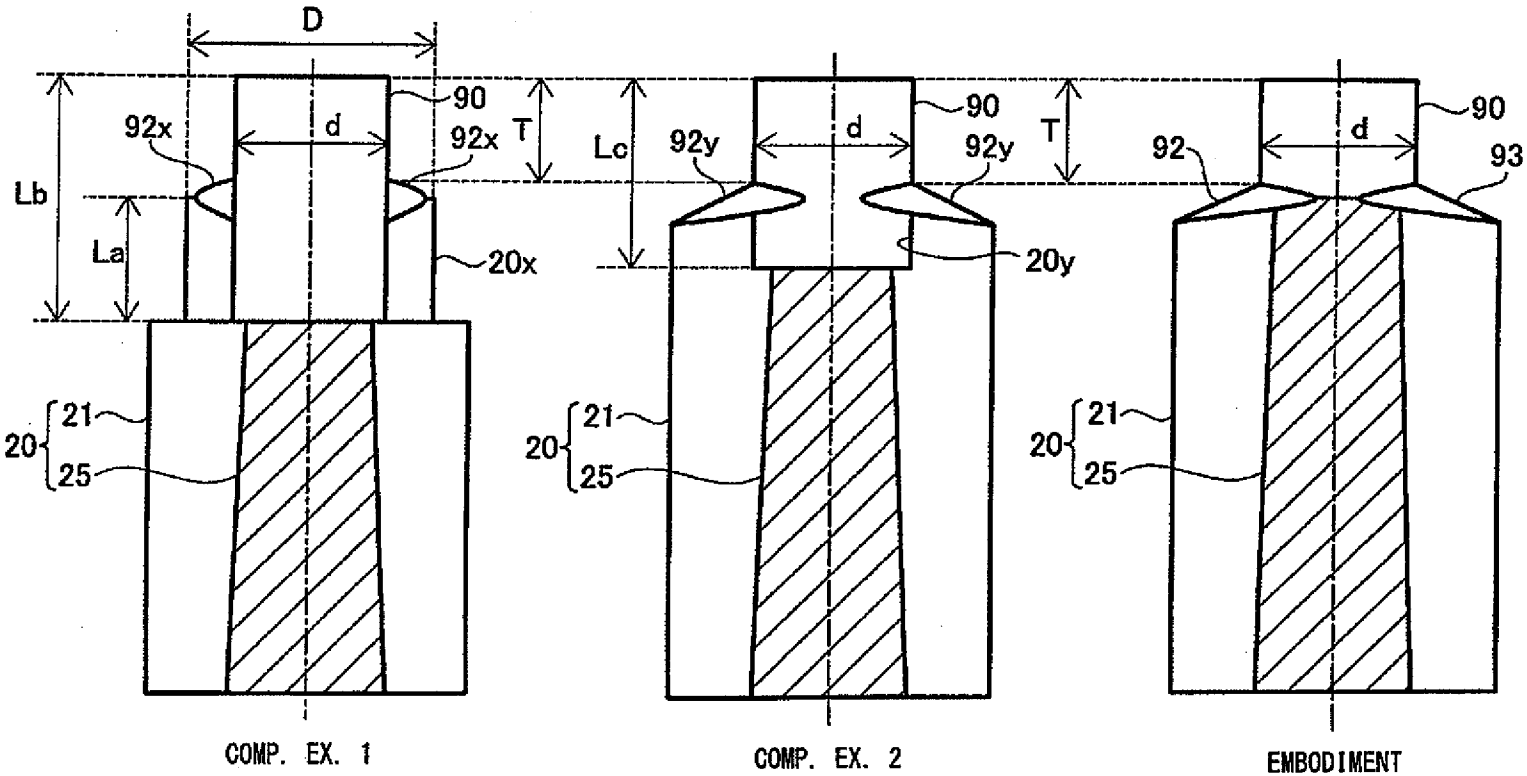
FIGS. 3A, 3B and 3C are sectional views of tip areas of the center electrodes of Comparative Examples 1 and 2 and an embodiment.

FIGS. 3A-3C show sectional views of tip areas of the center electrodes of Comparative Examples 1 and 2 and an embodiment. In Comparative Example 1, a support portion 20*x* is disposed at the forward end of a center electrode 20, the portion 20*x* surrounding the noble metal tip 90. The support portion 20*x* is formed of the same material as that of the electrode base member 21. The fusion portion 92*x* of Comparative Example 1 was formed through fusion of the support portion 20*x* and a microamount of the noble metal tip 90, and the inner layer 25 did not melt into the fusion portion 92*x*. That is, the fusion portion 92*x* of Comparative Example 1 contains no copper component.

In Comparative Example 2, the forward end of the center electrode 20 is provided with a dented portion 20*y* for accommodating a noble metal tip 90. Similar to Comparative Example 1, a fusion portion 92*y* of Comparative Example 2 contains no copper component. In contrast, the fusion portion 92 of the embodiment is in contact with the inner layer 25, and thus contains a component of the noble metal tip 90, a component of the electrode base member 21, and a copper component forming the inner layer 25. In Comparative Examples 1 and 2 and the embodiment, the exposed portions of the noble metal tips 90 have the same length and diameter. In Comparative Examples 1 and 2 and the embodiment, the following dimensions were employed.

Length of the exposed portion of the noble metal tip 90: T=0.6 mm

Diameter of the noble metal tip 90: d=0.6 mm

Length of the support portion 20*x*: La=0.6 mm

Diameter of the support portion 20*x*: D=0.9 mm

Length of the noble metal tip 90 of Comparative Example 1: Lb=1.3 mm

Length of the noble metal tip 90 of Comparative Example 2: Lc=1.0 mm

Figure 4:
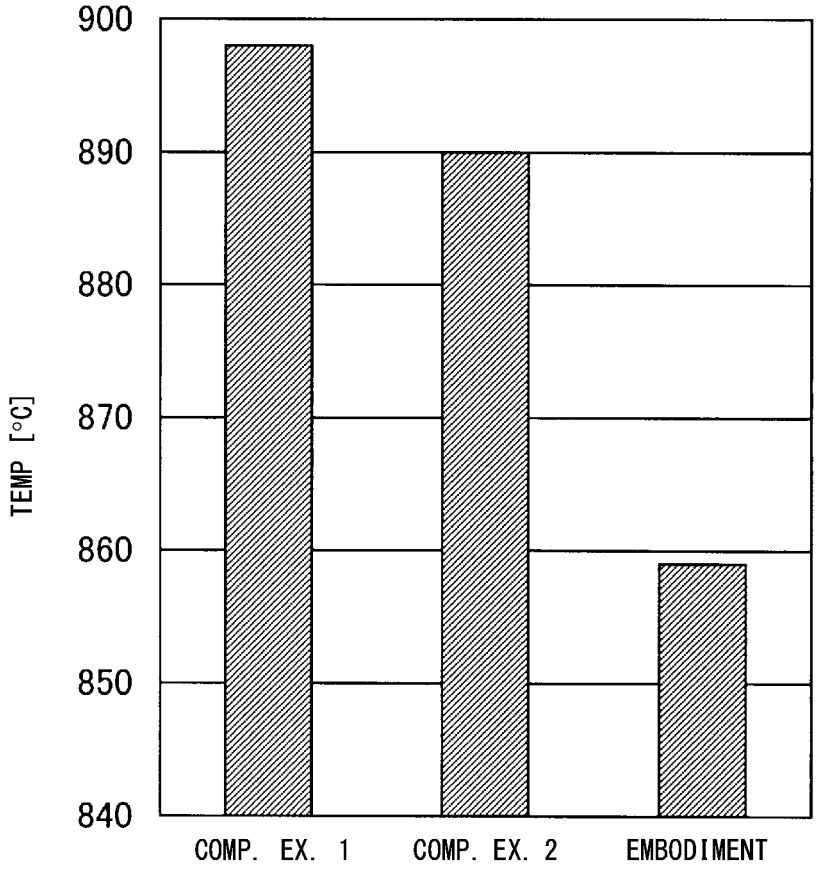
FIG. 4 is a graph showing heat transfer performance test results of Comparative Examples 1 and 2 and the embodiment.

FIG. 4 is a graph showing heat transfer performance test results of Comparative Examples 1 and 2 and the embodiment. As is clear from FIG. 4, in Comparative Example 1 the temperature of the noble metal tip did not substantially lower from 900° C. In Comparative Example 2, a temperature drop as small as 10° C. was observed. In contrast, in the embodiment, a temperature drop of 40° C. or more was observed. Thus, in the spark plug of the embodiment, the heat transfer performance of the fusion portion 92 was enhanced, whereby the heat transfer performance of the noble metal tip 90 was enhanced.

B2. Experimental Example for Elucidating the Relationship Between the Copper Content of the Fusion Portion 92 and Heat Transfer Performance In Experimental Example B2, in order to elucidate the relationship between the copper content of the fusion portion 92 and the heat transfer performance of the noble metal tip, a plurality of samples having different copper contents of the fusion portion 92 were provided. The noble metal tip 90 of each sample was heated to 900° C. by means of a burner, and then heating was stopped. Thirty seconds after termination of heating, the temperature of the discharge face of the noble metal tip 90 was measured by means of a radiation thermometer. The samples were assessed with comparison in terms of heat transfer performance. In Experimental Example B2, a sample having a noble metal tip 90 diameter of 0.6 mm, and a sample having a noble metal tip 90 diameter of 1.6 mm were provided. In the other Experimental Examples described hereinbelow, the two similar types of samples were provided for evaluation.

FIGS. 5B and 5C are explanatory views of two types of samples of the noble metal tip 90 having different diameters. The type 1 sample has a noble metal tip 90 diameter of 0.6 mm and a center electrode 20 diameter of 0.7 mm. The type 1 sample is produced by bonding a noble metal tip 90 to a tapered portion of a center electrode base parts 20*z* through welding.

Meanwhile, the type 2 sample has a noble metal tip 90 diameter of 1.6 mm and a center electrode 20 diameter of 1.7 mm. The type 2 sample is produced by cutting a forward end portion of a center electrode base parts 20*z* along a cutting line Z, and by bonding a noble metal tip 90 to the cut surface of the center electrode through welding. The "fusion portion depth c" indicated in FIGS. 5B and 5C (both samples) will be described in the below-described other Experimental Examples.

Figure 6:
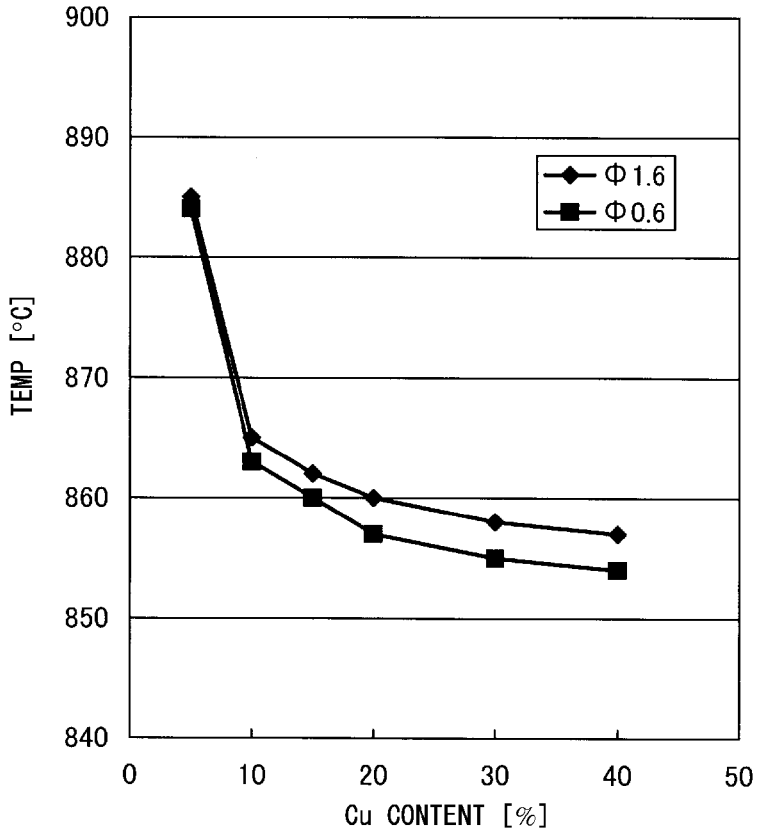
FIG. 6 is a graph showing the relationship between copper content of a fusion portion 92 and heat transfer performance of the noble metal tip 90.

FIG. 6 is a graph showing the relationship between the copper content of a fusion portion 92 and heat transfer performance of the noble metal tip 90. As is clear from FIG. 6, the larger the copper content of the fusion portion 92, the higher the heat transfer performance of the noble metal tip 90. Thus, the noble metal tip 90 can be readily cooled. This tendency was observed in the type 1 sample having a noble metal tip 90 diameter of 0.6 mm and the type 2 sample having a noble metal tip 90 diameter of 1.6 mm. More specifically, in both samples, when the fusion portion 92 has a copper content of 10 wt. %, the discharge face of the noble metal tip 90 can be cooled to about 865° C; when the copper content is 20 wt. %, the temperature can be lowered to about 860° C; and when the copper content is 30 wt. % or more, the temperature of the discharge face of the noble metal tip 90 can be decreased to a temperature lower than 860° C.

Thus, regardless of the diameter of the noble metal tip 90, the copper content of the fusion portion 92 is preferably 10 wt. % or more, more preferably 20 wt. % or more, particularly preferably 30 wt. % or more.

B3. Experimental Example for Elucidating the Relationship Between Inner Layer Width b and Heat Transfer Performance In Experimental Example B3, in order to elucidate the relationship between the inner layer width b and the heat transfer performance of the noble metal tip 90, a plurality of samples having different inner layer widths b were provided. The noble metal tip 90 of each sample was heated to 900° C by means of a burner, and then heating was stopped. Thirty seconds after termination of heating, the temperature of the discharge face of the noble metal tip 90 was measured by means of a radiation thermometer. The samples were assessed with comparison in terms of heat transfer performance.

Figure 7:
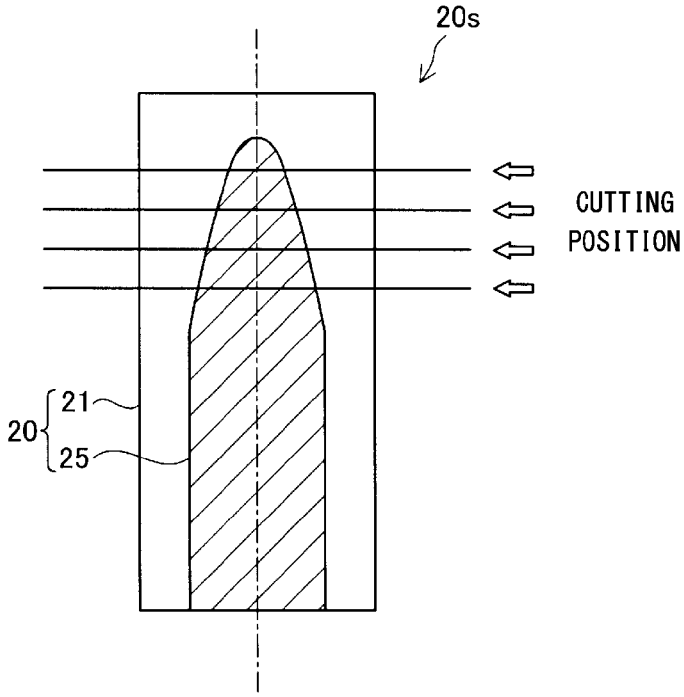
FIG. 7 is an explanatory view of a part of a step of producing samples having different core material widths b.

FIG. 7 is an explanatory view of a part of a step of producing samples having different inner layer widths b. In Experimental Example B3, there was provided a center electrode base parts 20*s* having an inner layer 25 tapered toward the forward end. By cutting the center electrode base parts 20*s* at different cutting positions, samples having different inner layer widths b were produced.

Figure 8:
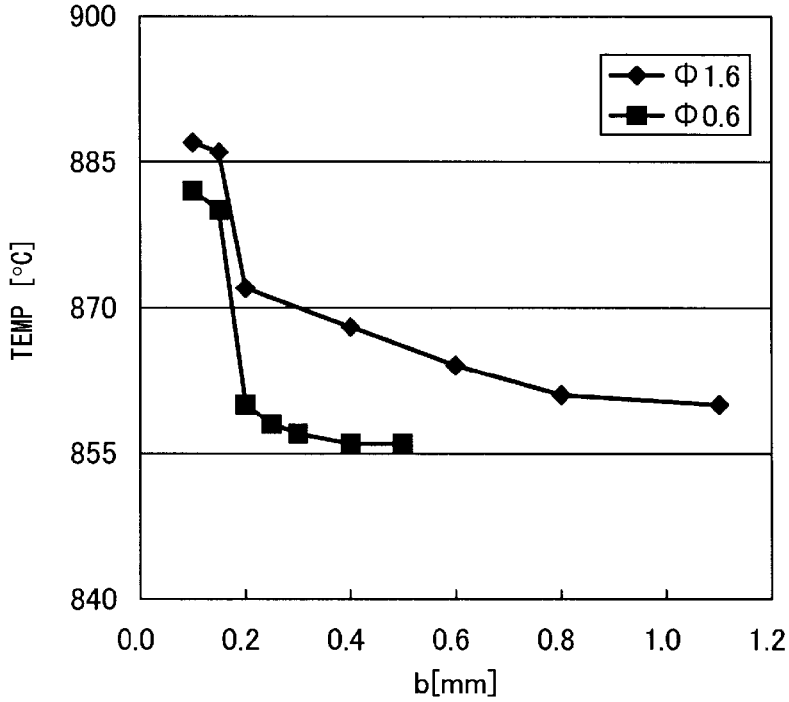
FIG. 8 is a graph showing the relationship between core material width b and heat transfer performance.

FIG. 8 is a graph showing the relationship between inner layer width b and heat transfer performance. As is clear from FIG. 8, the larger the inner layer width b, the higher the heat transfer performance of the noble metal tip 90. Thus, the noble metal tip 90 can be readily cooled. This tendency was observed in the type 1 sample having a noble metal tip 90 diameter of 0.6 mm and the type 2 sample having a noble metal tip 90 diameter of 1.6 mm. More specifically, in both samples, when the inner layer width b is 0.2 mm or more, a large temperature drop was observed in both types of samples. Furthermore, when the inner layer width b is increased to 0.3 mm or more, and 0.4 mm or more, the heat transfer performance of the noble metal tip 90 is gradually enhanced. Thus, regardless of the diameter of the noble metal tip 90, the inner layer width b is preferably 0.2 mm or more, more preferably 0.3 mm or more, particularly preferably 0.4 mm or more.

B4. Experimental Example for Elucidating the Relationship Between Fusion Width a and Heat Transfer Performance In Experimental Example B4, in order to elucidate the relationship between the fusion width a and the heat transfer performance of the noble metal tip 90, a plurality of samples having different fusion widths a were provided. The noble metal tip 90 of each sample was heated to 900° C. by means of a burner, and then heating was stopped. Thirty seconds after termination of heating, the temperature of the discharge face of the noble metal tip 90 was measured by means of a radiation thermometer. The samples were assessed with comparison in terms of heat transfer performance.

In Experimental Example B4, the depth c of the fusion portion 92 of each of the two types of samples (hereinafter may be referred to simply as "fusion depth c") was varied. As shown in FIG. 5, the fusion depth c is a length between the side surface of the noble metal tip 90 and the inner end of the fusion portion 92. The fusion width c was adjusted modifying the output of the laser beam for forming the fusion portion 92.

Figure 9:
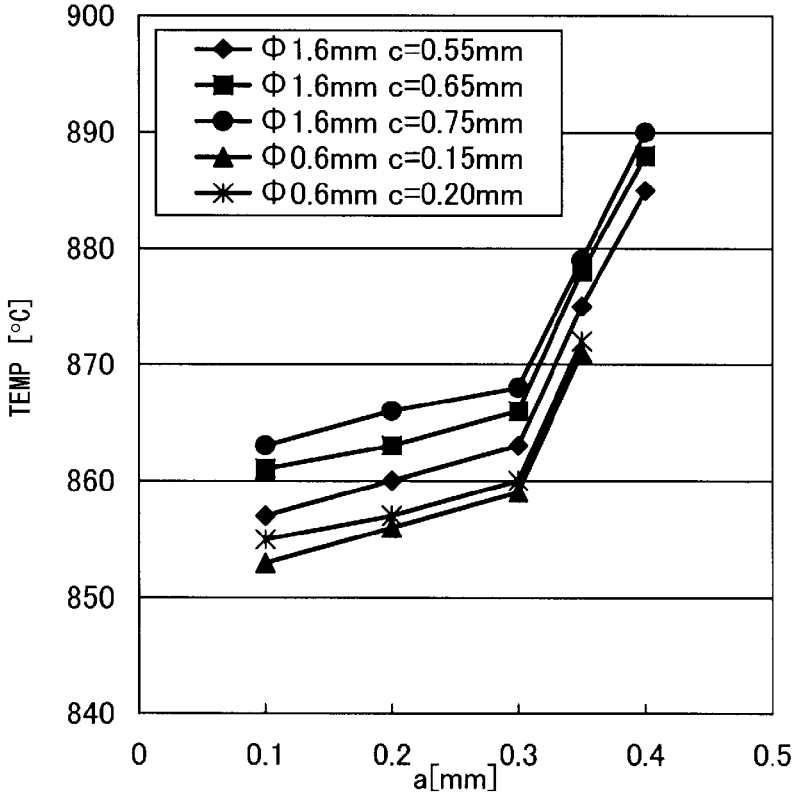
FIG. 9 is a graph showing the relationship between fusion width a and heat transfer performance.
Figure 10:
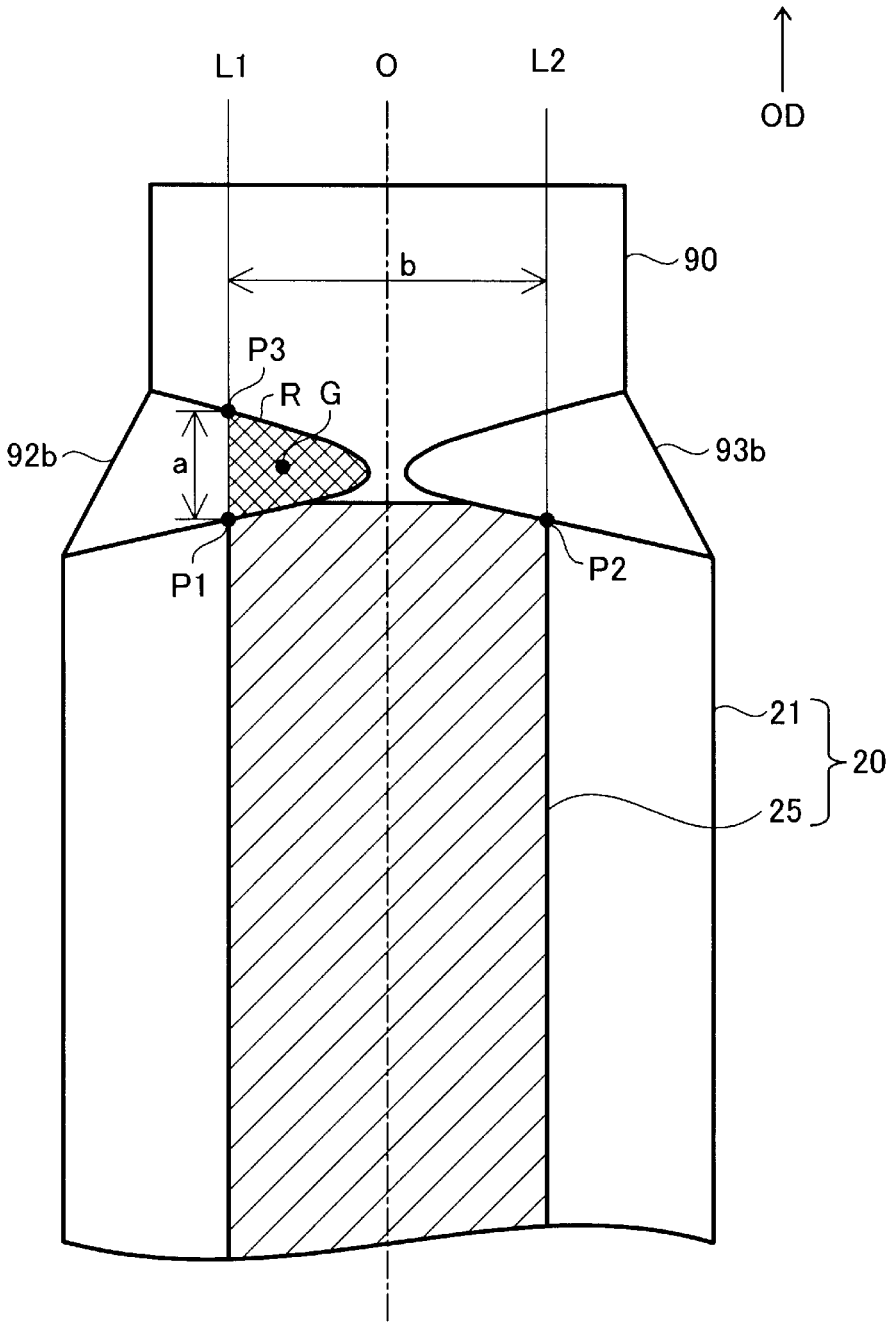
FIG. 10 is an enlarged sectional view of the center electrode 20 and the noble metal tip 90 of another embodiment.

FIG. 9 is a graph showing the relationship between fusion width a and heat transfer performance. As is clear from FIG. 9, the smaller the fusion width a, the higher the heat transfer performance of the noble metal tip 90. Thus, the noble metal tip 90 can be readily cooled. This tendency was observed in the type 1 sample having a noble metal tip 90 diameter of 0.6 mm and the type 2 sample having a noble metal tip 90 diameter of 1.6 mm. More specifically, in both samples, when the fusion width a is 0.3 mm or less, a large temperature drop was observed in both types of samples, and the temperature was decreased to a temperature lower than 870° C. Furthermore, when the fusion width a is decreased to 0.2 mm and 0.1 mm, the heat transfer performance of the noble metal tip 90 is gradually enhanced. Thus, regardless of the diameter of the noble metal tip 90 or the fusion depth c, the fusion width a is preferably 0.3 mm or less, more preferably 0.2 mm or less, particularly preferably 0.1 mm or less.

C. Other Embodiments

FIGS. 10 to 14 are enlarged sectional views of the center electrode 20 and the noble metal tip 90 of other embodiments. In an embodiment shown in FIG. 10, fusion portions 92*b*, 93*b* are formed so that they are shifted toward the noble metal tip 90 from the interface between the center electrode 20 and the noble metal tip 90. In this embodiment, the heat transfer performance of the fusion portions 92*b*, 93*b* and the noble metal tip 90 can also be enhanced.

Figure 11:
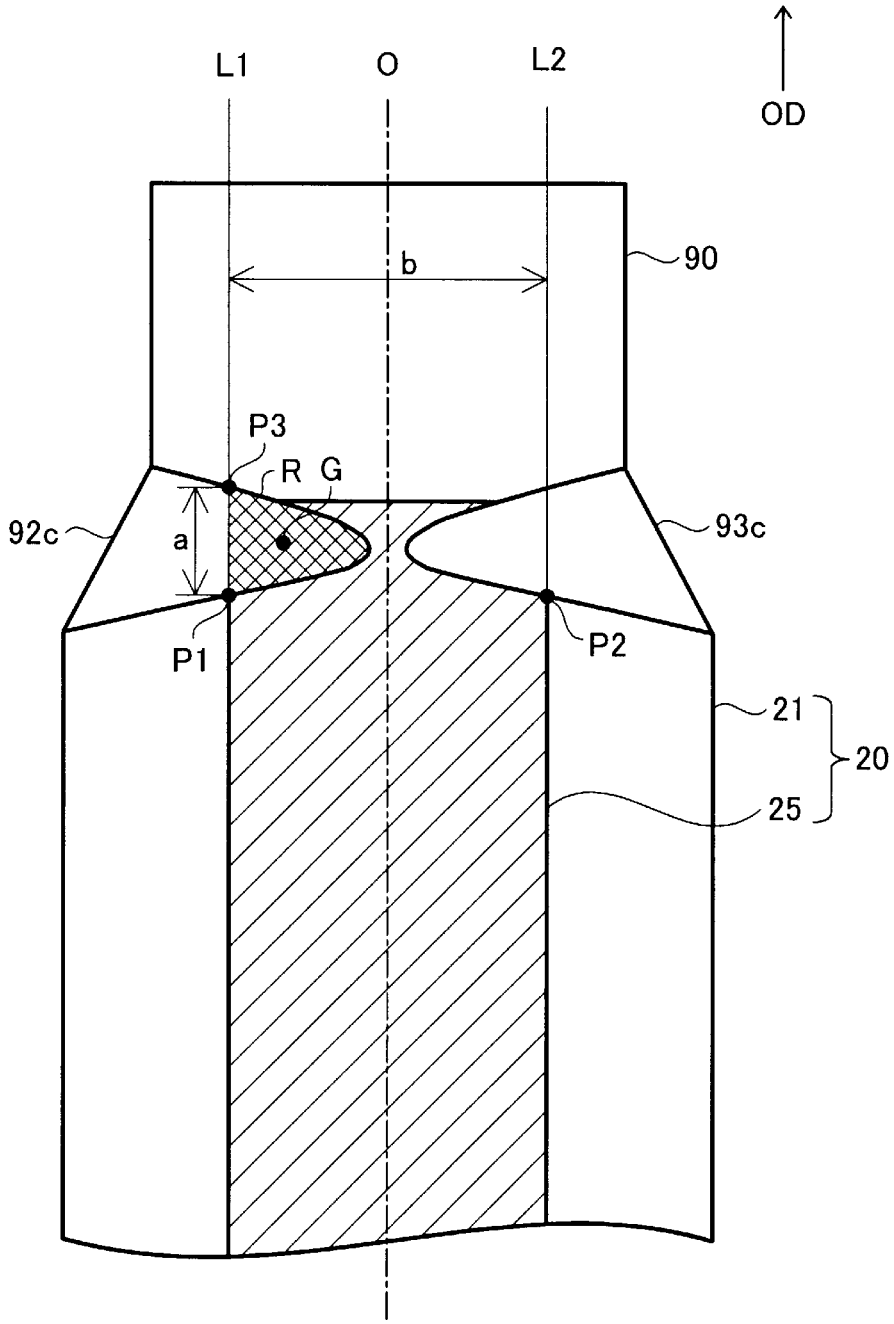
FIG. 11 is an enlarged sectional view of the center electrode 20 and the noble metal tip 90 of another embodiment.

In an embodiment shown in FIG. 11, fusion portions 92*c*, 93*c* are formed so that they are shifted toward the direction opposite the noble metal tip 90 from the interface between the center electrode 20 and the noble metal tip 90. In this embodiment, the heat transfer performance of the fusion portions 92*c*, 93*c* and the noble metal tip 90 can also be enhanced.

Figure 12:
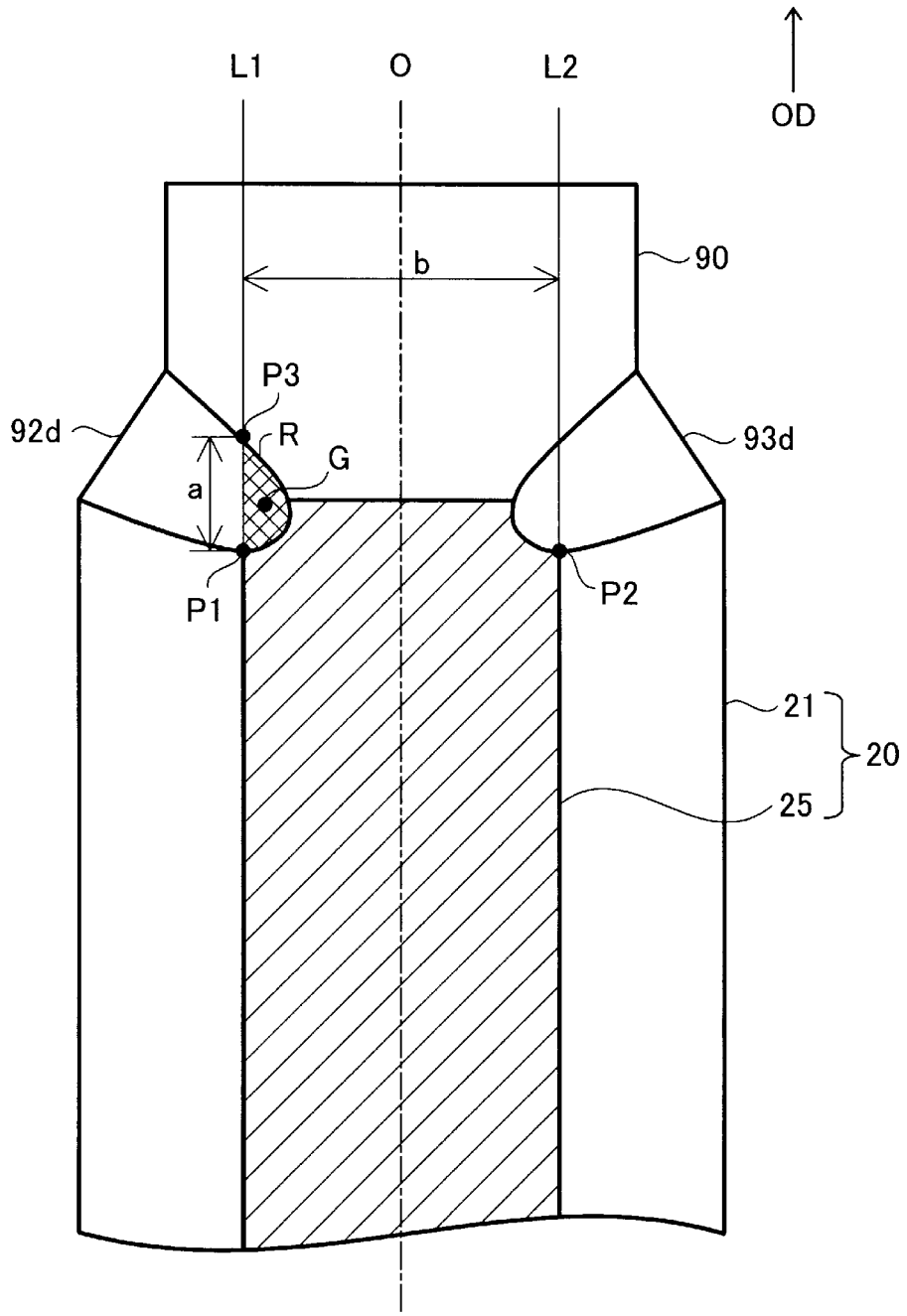
FIG. 12 is an enlarged sectional view of the center electrode 20 and the noble metal tip 90 of another embodiment.

In an embodiment shown in FIG. 12, fusion portions 92*d*, 93*d* are formed so that they are downwardly oblique with respect to the interface between the center electrode 20 and the noble metal tip 90 (i.e., oblique to the rear end direction of the spark plug). In this embodiment, the heat transfer performance of the fusion portions 92*d*, 93*d* and the noble metal tip 90 can also be enhanced.

Figure 13:
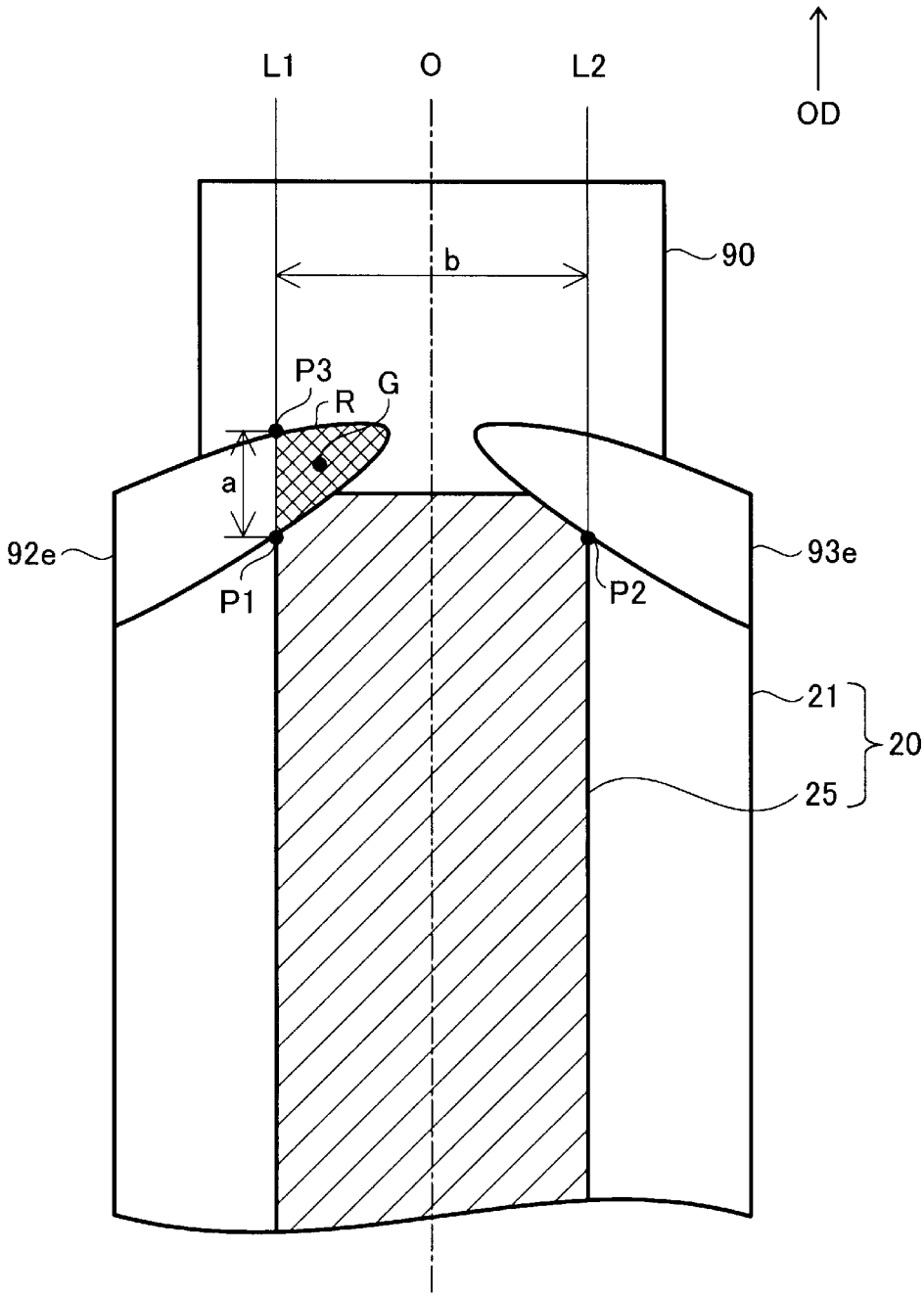
FIG. 13 is an enlarged sectional view of the center electrode 20 and the noble metal tip 90 of another embodiment.

In an embodiment shown in FIG. 13, fusion portions 92*e*, 93*e* are formed so that they are upwardly oblique with respect to the interface between the center electrode 20 and the noble metal tip 90 (i.e., oblique to the front end direction of the spark plug). In this embodiment, the heat transfer performance of the fusion portions 92*e*, 93*e* and the noble metal tip 90 can also be enhanced.

Figure 14:
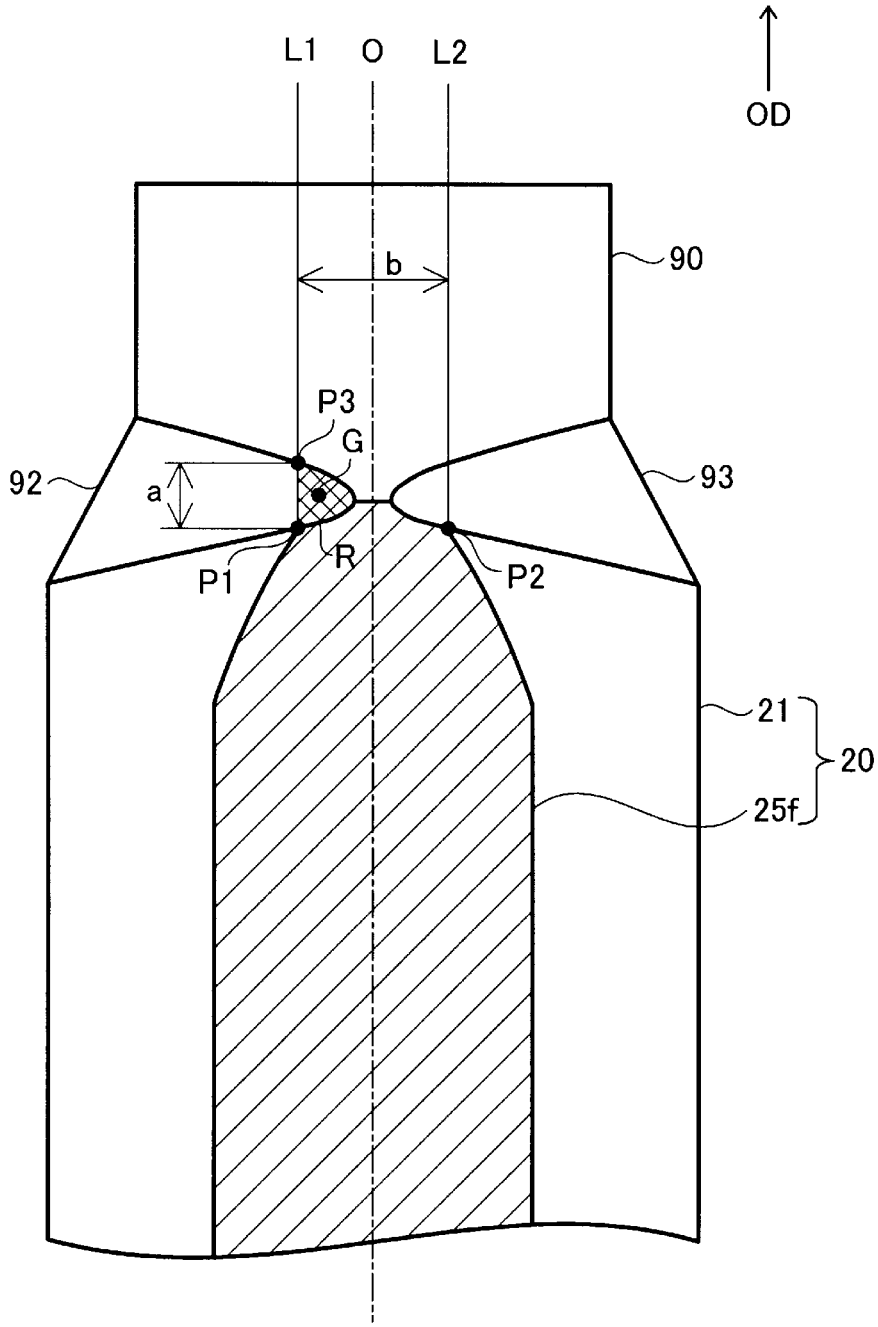
FIG. 14 is an enlarged sectional view of the center electrode 20 and the noble metal tip 90 of another embodiment.

In an embodiment shown in FIG. 14, an inner layer 25*f* is tapered toward the front end direction of the spark plug. In this embodiment, the heat transfer performance of the fusion portions 92, 93 and the noble metal tip 90 can also be enhanced.

D. Modifications

The present invention is not limited to the above-described examples and embodiment, but may be embodied in various other forms without departing from the gist of the invention. For example, the following modifications are possible.

D1. Modification 1

In the first embodiment, the fusion portion 92 and the second fusion portion 93 are separated from each other near the center axis. Alternatively, these fusion portions may be integrated near the center axis. In other words, in the cross section shown in FIG. 2, a fusion portion may be formed fully between the noble metal tip 90 and the inner layer 25 such that the noble metal tip 90 is not in contact with the inner layer 25. In the first embodiment, a left fusion portion with respect to the center axis O is represented by the fusion portion 92, and a right fusion portion with respect to the center axis O is represented by the second fusion portion 93. However, these two fusion portions may be alternatively disposed.

D2. Modification 2

In the above embodiment, the fusion portion 92 is continuously formed on the peripheral side surface of the noble metal tip 90. Alternatively, the fusion portion 92 may be formed partially on the side surface of the noble metal tip 90. In this case, when at least a part of the feature of the above embodiment is provided in a cross section which is parallel to the center axis O of the center electrode and which passes through the center axis O and the fusion portion 92, the heat transfer performance of the fusion portion 92 and the noble metal tip 90 can be enhanced.

D3. Modification 3

In the above embodiments, the electric discharge direction of the spark plug corresponds to the axial direction OD. Alternatively, in the present invention, the discharge direction may be orthogonal to the axial direction OD. That is, the invention also applied to a lateral-discharge-type spark plug.

D4. Modification 4

In the above embodiments of the spark plug, electrode tips (noble metal tips) 90, 95 are provided. However, the electrode tip (noble metal tip) 95 disposed at the end of the ground electrode 30 may be omitted.

Description of Reference Numerals

3: ceramic resistor
4: seal member
5: gasket
6: ring member
8: sheet packing
9: talc
10: ceramic insulator
11: corrugated portion
12: axial bore
13: leg portion
15: stepped portion
17: forward trunk portion
18: rear trunk portion
19: collar portion
20: center electrode
20*x*: support portion
20*y*: dented portion
20*z*, 20*s*: center electrode base parts
21: electrode base member
25, 25*f*: core material (inner layer)
30: ground electrode
33: distal end
40: metal terminal
50: metallic shell
51: tool engagement portion
52: mounting threaded portion
53: crimped portion
54: collar portion
55: seat surface
56: stepped portion
58: buckled portion
59: screw neck
90, 95: electrode tip (noble metal tip)
92, 92*b* to 92*e*, 92*x*, 92*y*: fusion portion
93, 93*b* to 93*e*: second fusion portion
100: spark plug
200: engine head
201: mounting threaded hole
205: peripheral-portion-around-opening
a: fusion width
b: inner layer width Having described the invention, the following is claimed:

1. A spark plug comprising:

a center electrode having an electrode base member and a core material which is disposed in the electrode base member and which predominantly contains copper; and a noble metal tip disposed at a forward end of the center electrode;

the spark plug has a fusion portion formed between the noble metal tip, and the electrode base member and the core material; and in a cross section which is parallel to the center axis of the center electrode and which passes through the center axis and the fusion portion the fusion portion is in contact with the core material and contains a component of the noble metal tip, a component of the electrode base member, and a copper component forming the core material.

2. A spark plug according to claim 1, wherein, in the cross section, the fusion portion has a copper component content of 10 wt.% or more at the centroid G of a region R which is defined between a straight line L1 and the center axis, wherein the straight line L1 passes through a point P1 and is parallel to the center axis, and the point P1 is on the interface between the fusion portion and the core material and is closest to the outer peripheral surface of the center electrode.

3. A spark plug according to claims 1 or 2, wherein, in the cross section, the spark plug satisfies a relationship: b≥0.2 mm, wherein b is a distance between a straight line L1 and a straight line L2; the straight line L1 passes through a point P1 and is parallel to the center axis; the point P1 is on the interface between the fusion portion and the core material and is closest to the outer peripheral surface of the center electrode; the straight line L2 passes through a point P2 and is parallel to the center axis; and the point P2 is on the interface between the core material and a second fusion portion formed on the side of the center axis opposite the fusion portion and is closest to the outer peripheral surface of the center electrode.

4. A spark plug according to claim 3, wherein, in the cross section, the spark plug satisfies a relationship: a≤0.3 mm, wherein a is a distance between a point P1 and a point P3; the point P1 is on the interface between the fusion portion and the core material and is closest to the outer peripheral surface of the center electrode; a straight line L1 passes through the point P1 and is parallel to the center axis O; and the point P3 is an intersection between the straight line L1 and an outline of the fusion portion on the noble metal tip side.

5. A spark plug according to claims 1 or 2, wherein, in the cross section, the spark plug satisfies a relationship: a≤0.3 mm, wherein a is a distance between a point P1 and a point P3; the point P1 is on the interface between the fusion portion and the core material and is closest to the outer peripheral surface of the center electrode; a straight line L1 passes through the point P1 and is parallel to the center axis O; and the point P3 is an intersection between the straight line L1 and an outline of the fusion portion on the noble metal tip side.

6. A spark plug according to claim 5, wherein, the noble metal tip is in contact with the core material.

7. A spark plug according to claims 1 or 2, wherein, the noble metal tip is in contact with the core material.

* * * * *